United States Patent [19]

Underwood

[11] 4,027,984

[45] June 7, 1977

[54] SHAMPOO BRUSH

[76] Inventor: Robert L. Underwood, 2302 Oxford, Fort Wayne, Ind. 46806

[22] Filed: Apr. 5, 1976

[21] Appl. No.: 673,640

[52] U.S. Cl. ..... 401/28; 401/46

[51] Int. Cl.[2] ..... A46B 11/00

[58] Field of Search ..... 401/28, 42–47; 137/568

[56] References Cited

UNITED STATES PATENTS

| | | | |
|---|---|---|---|
| 2,689,767 | 9/1954 | Dabringhaus | 401/46 |
| 2,866,221 | 12/1958 | Warva | 401/28 X |
| 3,405,997 | 10/1968 | Diebold | 401/46 |

*Primary Examiner*—Lawrence Charles
*Attorney, Agent, or Firm*—Gust, Irish, Jeffers & Rickert

[57] ABSTRACT

A shampoo brush having an elongate handle affixed to a housing having on one surface thereof a circumferential track for supporting a plurality of massaging tips in spaced relation and surrounded by cleansing and grooming bristles. Located in the housing centrally of the circumferential track is a container for a cleansing agent. A pair of spring urged plungers are mounted in corresponding cylinders in the chamber, each cylinder having two one-way valves so that on movement of the plungers against the spring force, one valve will open forcing cleansing agent from discharge orifices toward the surface to be cleansed, and on plunger movement in the opposite direction, the other valve in each cylinder will open filling the cylinder with the cleansing agent to be discharged on the next plunger movement. An annular enclosed passage is formed in the housing adjacent and within the circumferential track, said passage having a plurality of apertures for dispersing dilutant and rinsing fluid from the apertures. The passage is fed with rinsing fluid through a fluid line within the elongate handle. A manually operated valve is positioned in the handle to open and close the fluid line. The apertures in the annular passage are separate from the cleansing agent discharge orifices so that the rinsing fluid and cleansing agent are discharged separately and independently from one another.

2 Claims, 4 Drawing Figures

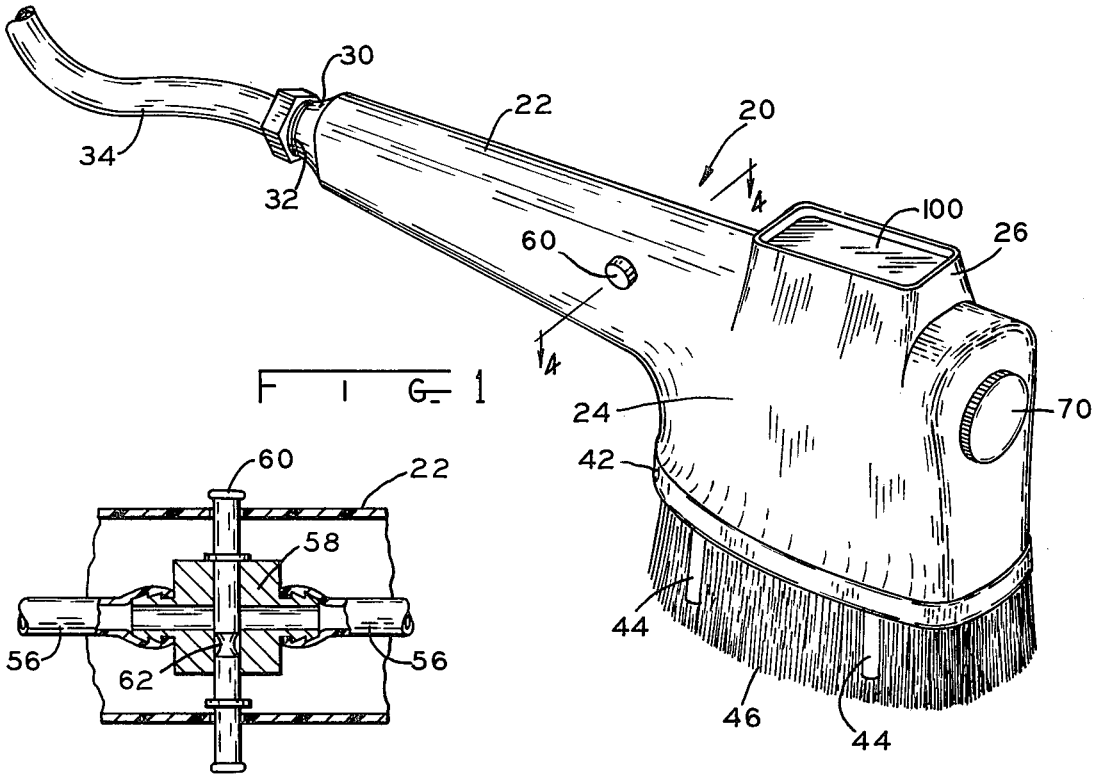
FIG. 1
FIG. 4
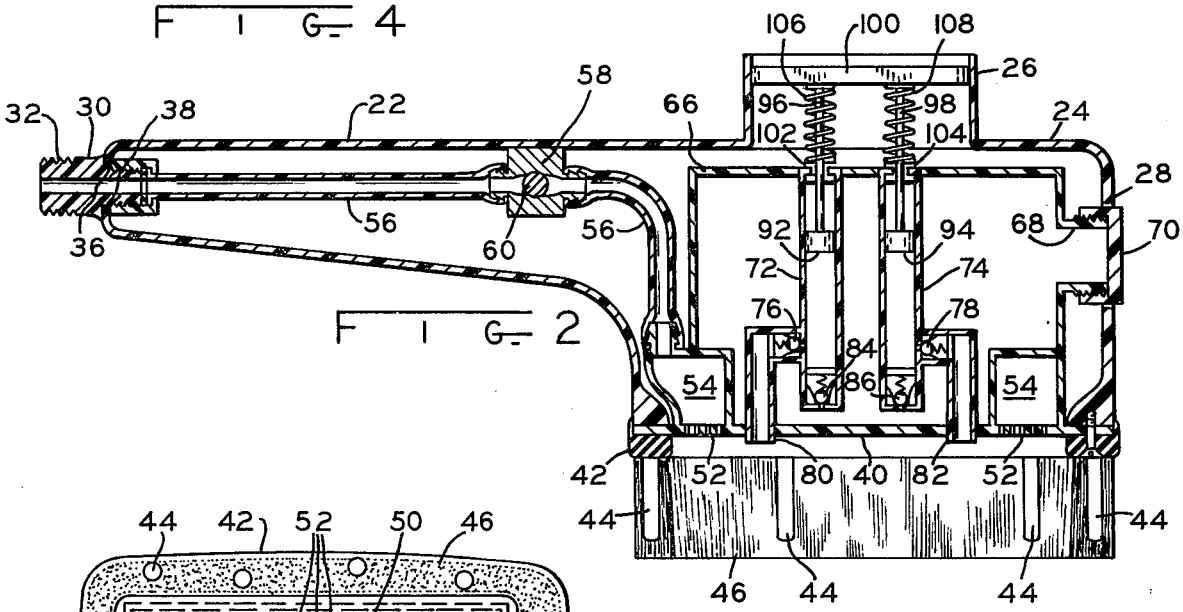
FIG. 2
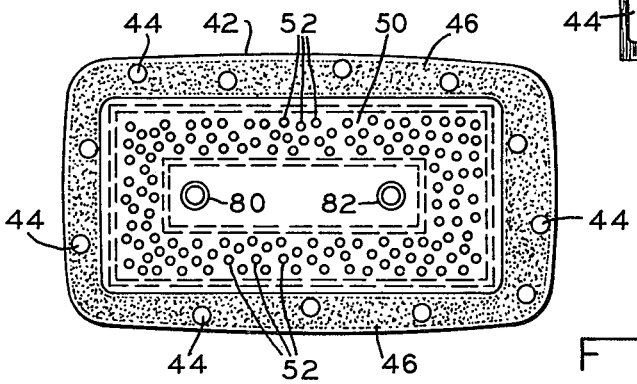
FIG. 3

SHAMPOO BRUSH

BACKGROUND OF THE INVENTION

1. Field of the Invention

This invention is in the field of shampoo brushes wherein a rinsing fluid, such as water, and a cleansing agent, such as shampoo, are discharged through a brushing surface.

2. Description of the Prior Art

Numerous shampoo brushes have been available for many years in the prior art. In general, these brushes administer a rinsing and dilutant fluid, such as water, under pressure, with a supply of shampoo which may be housed within the brush. The dilutant fluid and the shampoo are mixed in a mixing chamber which has orifices in communication with the brush bristles. It is difficult in these devices to properly and adequately control the desired amounts of shampoo to be used. This results from the manner of pre-mixing between the dilutant and the shampoo and the lack of an adequate system for dispensing the shampoo under pressure.

SUMMARY OF THE INVENTION

A shampoo brush having an elongate handle having at one end a connection for receiving a rinsing and dilutant fluid, such as water, from conventional water taps as are found in the home. At the other end of the handle is a housing which supports a chamber for receiving and storing a cleansing agent such as shampoo. One surface of the housing has a circumferential track which supports a plurality of flexible massaging tips spaced one from the other and a brush formed of bristles depending from the track and surrounding the tips. An enclosed annular passage is supported immediately above the bristle surface and has a plurality of apertures within the bristle track. The passage is supplied with rinsing fluid by a fluid line in the handle having mounted therein an on-off valve operable manually by the user. Thus, when the valve is switched on, fluid, such as from a household water tap, will flow through the line, into the passage, and out the apertures.

The chamber supports two cylinders therein, each having a one-way fluid valve for providing one-way fluid communication from the chamber into the cylinder and a second one-way valve for providing one-way fluid communication from the cylinder to a discharge orifice located within the annular passage on the housing surface. Each cylinder has mounted therein a spring-urged plunger, which plungers are connected by a common finger actuated plate extending from the housing top so that upon depression of the plate, against the spring forces, the plungers will move downwardly in the cylinders forcing the shampoo in the cylinders through one-way valves into the discharge orifices. Releasing the plate will cause reverse movement of the plungers in the cylinders, whereupon shampoo will enter the cylinders from the container in which the cylinders are mounted. In this manner, a positive pumping action which is sensitive to the precise supply demands of the shampoo by the user is provided. The shampoo may be dispensed with or without a rinsing and diluting fluid without passing through a mixing chamber.

It is therefore an object of this invention to provide a shampoo brush having controls for dispensing shampoo in the exact and precise quantity demanded.

Another object of this invention is to provide a brush of the foregoing object wherein the shampoo and rinsing fluid may be separately controlled, independently of one another, for application to the surface to be cleansed.

It is an object to provide in the brush of the foregoing objects a volume of shampoo under a pressure commensurate with that of the rinsing and diluting fluid.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWING

FIG. 1 is a view in perspective of a preferred embodiment of this invention;

FIG. 2 is a longitudinal sectional view of the embodiment of FIG. 1;

FIG. 3 is a bottom plan view of the embodiment of FIG. 1; and

FIG. 4 is a partial, sectioned view of the handle mounted valve taken at 4-4.

DESCRIPTION OF A PREFERRED EMBODIMENT

Referring to the drawing, brush 20 has elongate handle 22 integrally formed with a housing 24 having a tubular extension 26 formed through the upper side thereof. Handle 22 has fitting 30 which is threaded at 32 to receive a hose 34 in fluid tight engagement. Hose 34 may be attached to a conventional water tap to receive water under tap pressure. Fitting 30 has a groove 36 for receiving the edge of opening 38 in handle 22.

Housing 24 supports a circumferential track 42 from which depends in spaced relation flexible massaging bristles 44. Bristles 46 also depend from track 42 and surround tips 44. An annular surface 50 is within track 42 and is perforated with a plurality of apertures 52 for providing fluid communication between an annular enclosed passage 54 positioned immediately above surface 40 and the bristle side of surface 40. Passage 54 is connected by line 56 in handle 22 through a conventional, commercially available, slide valve which operates to selectively open or close line 56. A valve block 58 is connected at either end to line 56. A slide 60, having a reduced section 62 formed intermediately thereon, is slidably mounted in block 58. Manipulating slide 60 in a leftward direction (FIG. 1), will align section 62 with passage 56 to open the line 56, and manipulating slide 60 in a rightward direction will close line 56. The other end of line 56 is in fluid tight engagement with fitting 30.

A chamber 66 is located within housing 24 and fits over and within annular passage 54. Chamber 66 has threaded spout 68 which extends through opening 28 and threadedly receives cap 70. Removal of cap 70 will permit filling or emptying of chamber 66.

Formed in chamber 66 are two elongate parallel cylinders 72, 74 having one-way valves 76, 78 respectively formed near the lower ends thereof for providing one-way fluid communication between their respective cylinders and discharge tubes 80 and 82 respectively which extend through openings in surface 40. Cylinders 72 and 74 also have formed at their respective ends one-way valves 84 and 86 which provide one-way fluid communication between the interior of chamber 66 and cylinders 72 and 74, respectively. Valves 76, 78, 84 and 86 may be of any conventional well-known one-way valve construction such as a ball which is seated against a valve seat under spring pressure. The ball may be lifted against the spring to open when fluid flow is in one direction, but will be forced against the valve seat in fluid tight engagement when the pressure is from the other direction.

Slidably supported in cylinder 72 and 74 are plungers 92 and 94 respectively. Plunger rods 96, 98 extend upwardly from and are affixed to plungers 92 and 94 respectively and are connected to a plunger plate 100 at their upper ends. Rods 96 and 98 are slidably mounted in washers 102, 104 respectively which are fitted in openings in the top of housing 66. Compression springs 106 and 108 are placed about rods 96 and 98 respectively and urge plate 100 in an upward direction. Plate 100 reciprocates in extension 26 and is finger accessible for depression therein against the force of springs 106 and 108. A pair of double-acting pumps is thus provided. Depression of plungers 92 and 94 in cylinders 72 and 74 respectively force shampoo, or other cleansing agent, from the interiors of cylinders 72 and 74 through one-way valves 76 and 78 through discharge tubes 80 and 82 respectively, and at the same time close valves 84 and 86. Upon release of plate 100, plungers 92 and 94 will return in an upward direction under spring force to close valves 76 and 78 and open valves 84 and 86 thus admitting cleansing agent to the interior of cylinders 72 and 74 from container 66 thus filling cylinders 72 and 74 to make available a cleansing solution to be discharged on the next depression of plate 100.

In operation of this embodiment, if just shampoo is desired by the user, slide 60 is moved to its closed position to shut off rinsing and dilutant fluid therethrough and plate 100 is pumped downwardly to provide shampoo through discharge tubes 80 and 82. The amount of shampoo discharged can be very accurately controlled by controlling the number and length of downward strokes applied to plate 100. Further, the shampoo or cleansing agent will be administered under pressure through tubes 80 and 82 directly on the surface to be cleansed. When it is desired to provide a dilutant together with the shampoo or cleansing agent, slide 60 is moved to open line 56 thus providing fluid communication between fitting 30 and passage 54 causing fluid to be discharged under pressure through apertures 52. Thus it is seen that the dilutant is discharged separately from the discharge of the shampoo. If rinsing is desired, valve 58 is moved to the open position and plate 100 is not pumped. Thus, maximum control over the amount of shampoo applied to the surface to be cleansed is possible. The mix of water to shampoo can be instantly changed as desired. Handle 22 and housing 24 may be of a molded plastic and chamber 66 with cylinders 72 and 74 and discharge tubes 80 and 82 may also be of a molded plastic. Plungers 92, 94 an plunger rods 96, 98 further may be of a molded plastic as may be other component parts of brush 20 to provide an attractive, lightweight, non-corrosive, economical construction.

While there have been described above the principles of this invention in connection with specific apparatus, it is to be clearly understood that this description is made only by way of example and not as a limitation to the scope of the invention.

What is claimed is:

1. A shampoo brush comprising:

an elongate hollowed handle having a rinsing and dilutant conduit supported therewithin; a housing affixed to said handle and having a shampoo chamber supported therewithin;

said chamber having a plurality of shampoo dispensative first openings formed therein for dispensing shampoo in a first direction; said first openings being symmetrically disposed about a plane parallel to said first direction and substantially bisecting said housing;

pump means for receiving and dispensing shampoo being supported within said chamber; said pump means having a first passage in fluid communication with said chamber and a second passage in fluid communication with said openings; plunger means being reciprocably mounted in said pump means; a pair of first and second one way valves being mounted in said first and second passages respectively and cooperable to admit shampoo into said pump means upon movement of said plunger means in said pump means in one direction and to dispense shampoo from said first openings upon movement of said plunger means in the opposite direction;

an annular fluid chamber being supported in said housing around said shampoo chamber; said annular chamber being in fluid communication with said dilutant conduit;

said housing supporting a surface immediately adjacent said annular chamber and in fluid communication therewith; said surface having a plurality of second openings therein for dispensing rinsing and dilutant fluid in said first direction; said annular chamber supplying said second openings with rinsing and dilutant fluid;

said first openings being positioned within and extending through said surface; an annular track being supported in said housing around said surface; said track supporting a plurality of flexible, resilient elements extending in said first direction and adapted to contact, groom and massage the body area to be shampooed.

2. The apparatus of claim 1 wherein said pump means comprises two separate manually operable pumps each having a plunger reciprocably mounted therein and each having said passages and said pair of one way valves mounted therein; a finger accessible pressure plate affixed to each of the plungers to operate said plungers in unison.

* * * * *